United States Patent [19]

Raudat et al.

[11] 4,048,783

[45] Sept. 20, 1977

[54] CASE LOADER WITH INVERT GRID AND PUSHDOWN FEATURE

[75] Inventors: John L. Raudat, Madison; Lloyd D. Johnson, Portland, both of Conn.

[73] Assignee: Emhart Industries, Inc., Hartford, Conn.

[21] Appl. No.: 743,341

[22] Filed: Nov. 19, 1976

[51] Int. Cl.[2] ..... B65B 57/10; B65B 35/56

[52] U.S. Cl. ..... 53/61; 53/161; 198/403; 214/1 Q

[58] Field of Search ..... 53/61, 161, 143; 198/403; 214/1 Q, 1 QA

[56] References Cited

U.S. PATENT DOCUMENTS

| | | | |
|---|---|---|---|
| 3,694,993 | 10/1972 | East | 53/61 X |
| 3,908,812 | 9/1975 | Graff | 53/161 X |

*Primary Examiner*—Travis S. McGehee

*Attorney, Agent, or Firm*—McCormick, Paulding & Huber

[57] ABSTRACT

Articles are fed in a plurality of lanes from an infeed conveyor, across a deadplate, and into a grid which has lane defining structure adapted to expand and to hold the articles while the grid is inverted. After a charge is formed in the grid, means is provided for holding back articles on the deadplate and for retracting the grid slightly to separate articles in the grid from those on the deadplate. Riding strips, or rails, support the articles in the grid, and latch means provided in part on a vertically reciprocable yoke, and in part on these rails is latched by rotation of the grid and unlatched in response to reset or return motion of the retractable grid. After rotation and retraction of the grid, the articles are released, and the yoke and the rails push the articles out of the grid. The rails and grid are then reset, the unlatched yoke raised, and the holdback releases the articles for loading a succeeding charge without the necessity for return rotational motion of the rails and grid.

24 Claims, 20 Drawing Figures

CASE LOADER WITH INVERT GRID AND PUSHDOWN FEATURE

BACKGROUND OF THE INVENTION

This invention relates generally to packing case loading devices and deals more particularly with a case loader adapted to receive successive charges from a continuously operating infeed conveyor, and which includes a grid, rotatable on an axis aligned with the conveyor, to invert the articles, and to push the articles downwardly into an upwardly open packing case.

U.S. Pat. No. 3,702,524 issued to Johnson et al. in November 1972, shows such a device with upper and lower lane defining capsules and with doors for holding the articles during invert. Only one capsule is used in the the present disclosure and this single capsule not only has an operating speed equal to or higher than that disclosed in the Johnson patent, but also provides for an improved means for ejecting the articles from the inverted capsule or grid.

U.S. Pat. No. 3,834,117 issued to Gift in September 1974 shows an invert grid with expandable lane defining structure for holding articles during the invert motion of the grid. The advantages of the Gift patent are further enhanced by the features of the present disclosure and both of these prior patent disclosures are incorporated herein by reference.

The aim of the present invention is to provide a single capsule invert grid capable of the same, or higher operating speed as the double grid disclosed in Johnson, taking advantage of the article holding features of Gift, in an apparatus which also has the capability for pushing the articles out of the grid by means of the same riding strips or rails which support the articles in the grid as the charge is being formed. These strips, and the grid, need not be returned to their starting positions in the cycle of operation, and are instead immediately positioned so as to receive a succeeding charge from the infeed conveyor once the inverted charge has been deposited in the upwardly open packing case.

SUMMARY OF THE INVENTION

In accordance with the present invention an infeed conveyor is provided with rows, or columns of articles, adapted to be fed to a capsule or grid. The grid defines several lanes for receiving the articles, and the lane defining structure includes expandable portions which hold the articles in place so that the grid can be inverted and the articles subsequently released for depositing the entire charge into a packing case. The articles ride on strips or rails as they enter the grid, and these same rails are movably mounted in the grid to positively push the articles out of the inverted grid. As a result of this motion of the rails they assume a position wherein a second charge of articles can be formed in the grid while it remains inverted. When the second charge has been so formed, the cycle is repeated.

BRIEF DESCRIPTION OF THE DRAWINGS

FIG. 1A shows the articles having been loaded in the grid,

FIG. 1B showing the grid being inverted,

FIG. 1C shows the grid in the rotated or inverted position, and

FIG. 1D shows the articles as they are pushed downwardly out of the grid and into the packing case.

FIG. 3A also shows the grid structure retracted slightly away from the infeed conveyor so as to provide clearance between the articles in the gride and those held on the deadplate associated with the infeed conveyor.

DETAILED DESCRIPTION

Figure 1A:
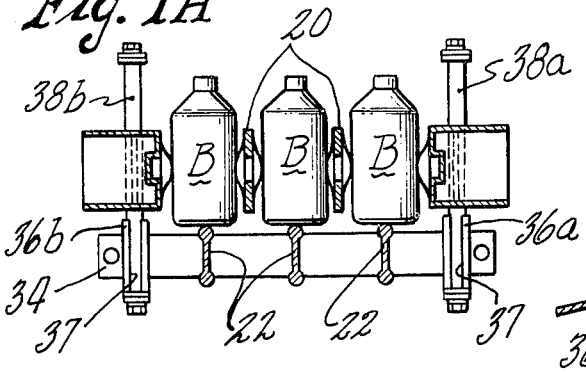
FIGS. 1A, 1B, 1C and 1D are schematic elevational views looking in the upstream direction of an invert grid, and illustrate the basic sequence of operation for the structure disclosed.
Figure 1D:
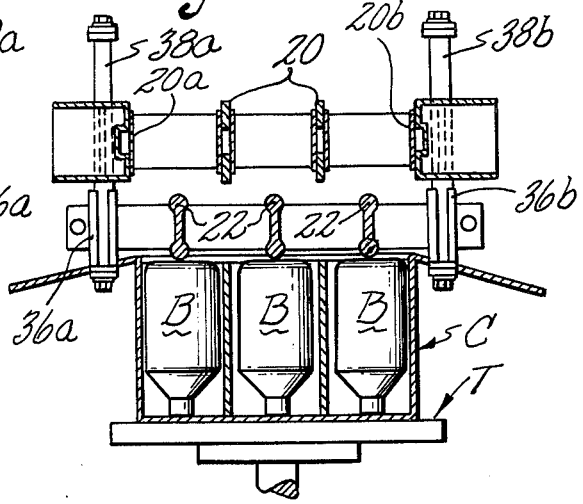

The invert grid and pushdown apparatus of the present invention is intended for use at the downstream end of an infeed conveyor, and more particularly is adapted to receive rows or columns of articles from such an infeed conveyor and to preserve this configuration of the articles so that discrete and charges or slugs of articles are formed in the grid structure so that they can be inverted and pushed downwardly out of the grid, and either directly into an upwardly open packing case, as illustrated in FIGS. 1A–1D inclusively, or through a funnel to guide the articles as they are pushed downwardly into the case. A deadplate is preferably associated with the downstream end of the infeed conveyor as best shown in FIG. 2B wherein the infeed conveyor is indicated generally at 10 and the deadplate 12. FIG. 2A shows the articles B, B arranged in orderly rows and adapted to be fed in the direction of the arrow 14 by the infeed conveyor 10 between lanes 17, 17 so that the line pressure of the articles feeds these articles across the deadplate 12 and into lane defining structure in the invert grid structure, indicated generally at 16 in FIG. 2B.

FIGS. 1A–1D inclusively illustrate the grid structure in position for receiving the articles and for holding the articles so that the charge of articles can be inverted as shown. Preferably, the lane defining structure of the grid includes expandable lanes such as indicated generally at 20, 20 in FIG. 1A and each of these lanes defining elements preferably includes an expandable bladder such that inflation of this bladder serves to grip the articles between these lane defining elements 20, 20 in order to securely hold the articles during the invert motion. The reader is referred to prior U.S. Pat. No. 3,834,117 to Gift for a more detailed description of the configuration for these lane defining elements. Basically, in an invert grid equipped with such expandable lane defining structure, certain of the lane defining elements are adapted to expand and contract in response to control signal or the like. Each of the expandable lane defining elements includes laterally spaced resilient plates with upper and lower support means associated with the upper and lower marginal edges of these resilient plates to restrain these marginal edges against movement at least in a direction toward and away from one another. An inflatable bladder of elastomeric material is preferably provided between these plates and the longitudinally extending bladder is provided midway between the upper and lower marginal edges of the plates. Means is provided for retaining the bladder in centered relationship of these plates so that the bladder is retained in position even when noninflated. Thus, upon inflation, the plates are bowed outwardly with respect to one another in order to grip the articles between adjacent lane defining elements.

With reference to FIGS. 2A, the articles B, B are fed in the direction of the arrow 14 into the grid structure while the lane defining elements are deflated. Means is provided for supporting the articles in the grid as they are so fed, and preferably said means comprises riding strips such as those indicated generally at 22, 22, and it is an important feature of the present invention that these strips or rails are movably mounted in the grid so that they not only support the articles moving into the grid as depicted in FIGS. 2A and 2B, but so that said strips also serve the additional purpose of pushing the articles from the grid after the grid has been inverted, as shown in FIG. 1D,

Still with reference to the rotating grid structure, the land defining elements 20, 20 are mounted at their downstream ends to a plate 24 and to accommodate three side-by-side rows, or columns of articles, the grid structure includes two median lane defining elements 20, 20 together with two outside lane defining elements **20*a*, 20*b*. All of these lane defining elements include the expandable bladder construction referred to previously and all of them are mounted to the plate 24 in cantilevered fashion so as to extend in the upstream direction, and to define openings between their upstream ends for receiving the articles B, B. A support shaft 26 is journalled in bearing blocks 28, 28 mounted in a retract carriage 30 which carriage 30 is slidably supported in the fixed machine frame F on guide rods best shown in FIG. 2B. A motor M is provided on the retract carriage 30, and is adapted to rotate the grid through 180° from the position shown in FIG. 1A, to the inverted position illustrated in FIG. 1D. Motor M preferably comprises an air driven device with a rack gear connected to its movable part and meshing with a pinion on the shaft 26.**

Figure 2A:
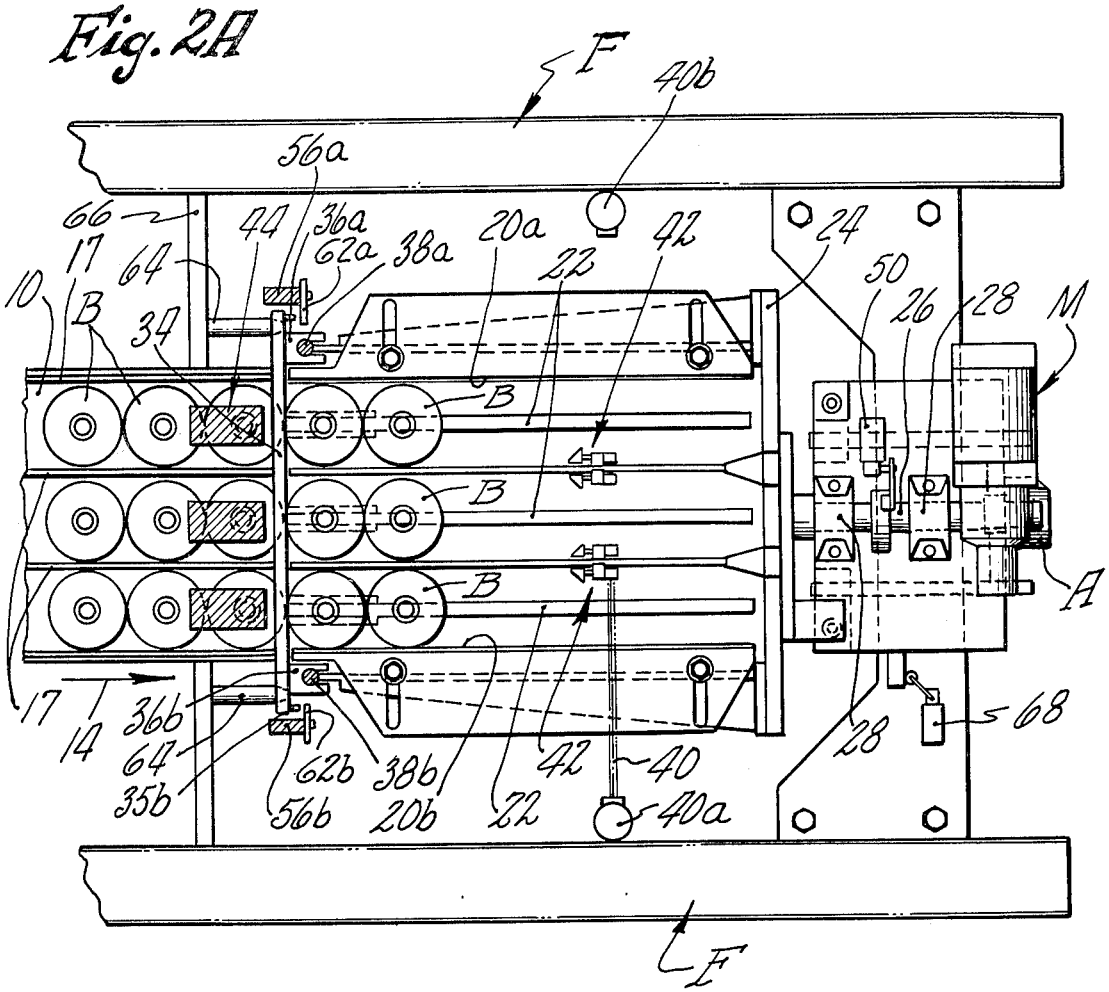
FIG. 2A shows the presently preferred embodiment in plan view with the articles moving off the infeed conveyor across the deadplate into the capsule or grid structure.
Figure 2B:
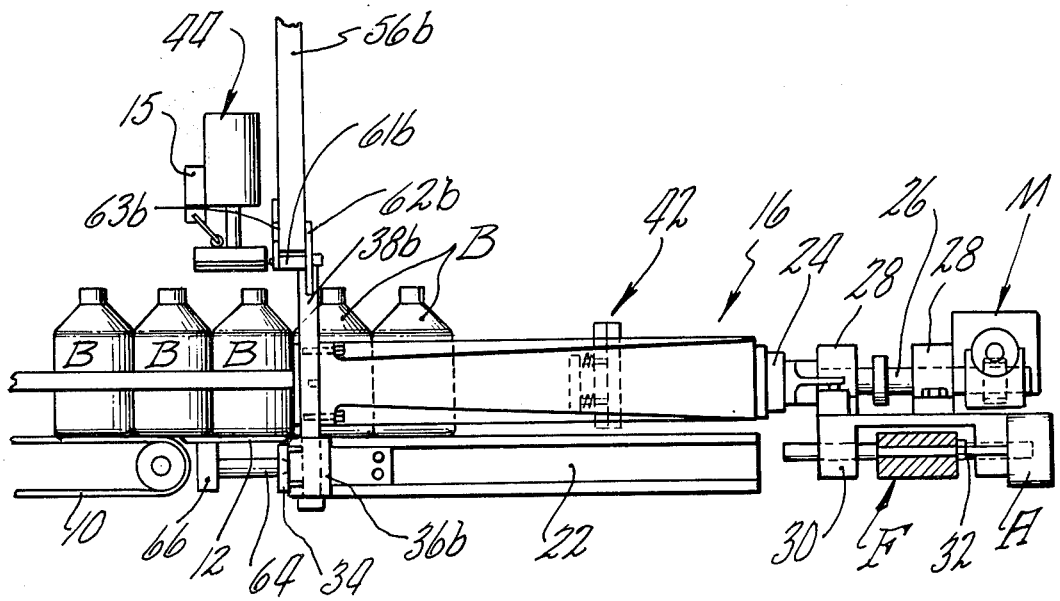
FIG. 2B shows the apparatus of FIG. 2A in side elevation.
Figure 3A:
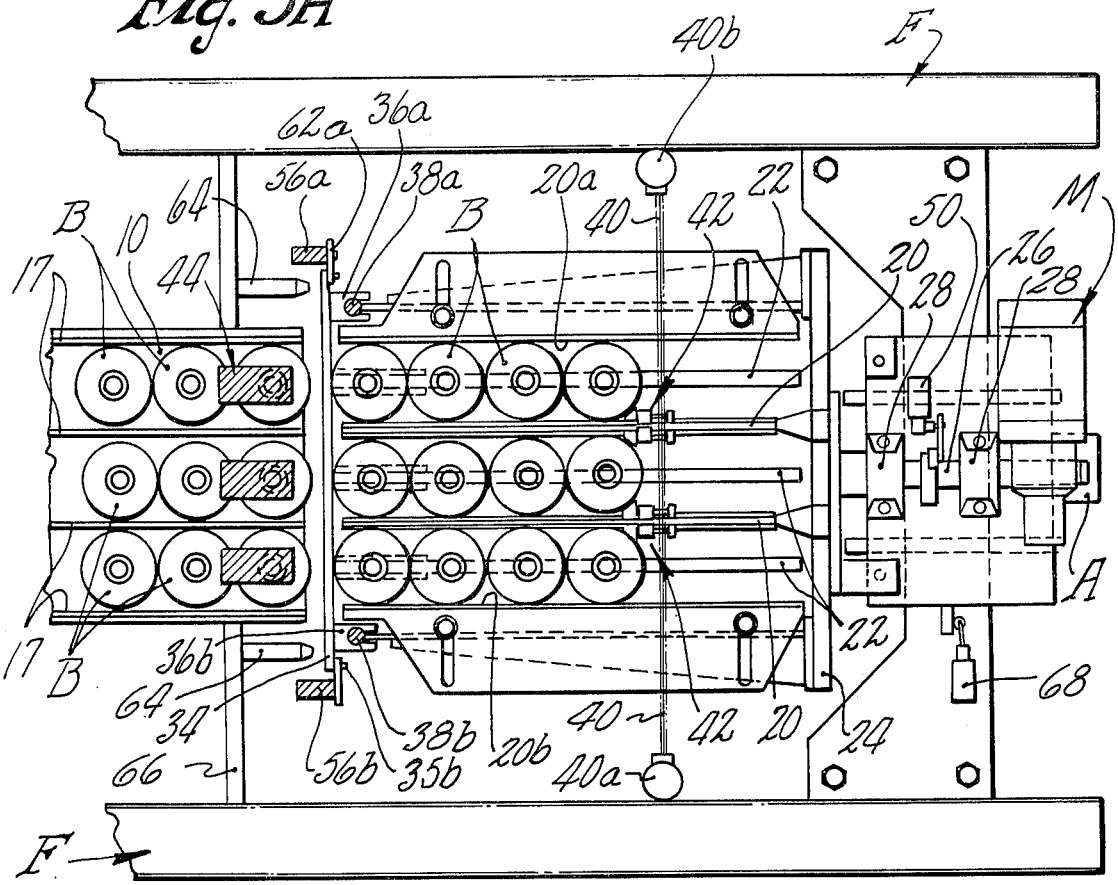
FIG. 3A is similar to FIG. 2A by showing the charge of articles after it is formed in the grid structure, and illustrating the detecting means for the articles in a positive condition, indicating that the grid means has been loaded.
Figure 3B:
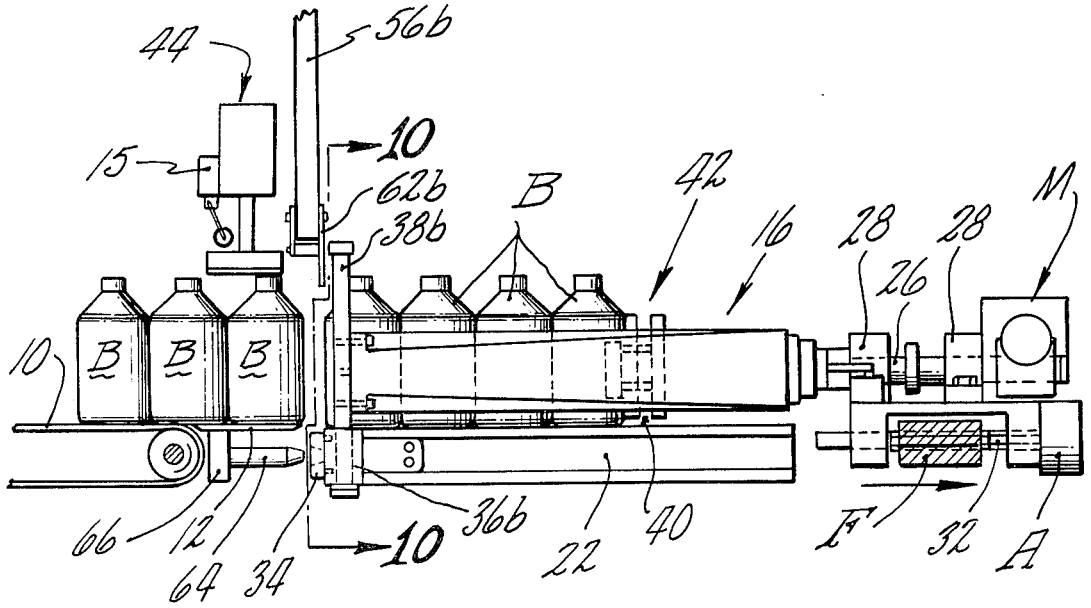
FIG. 3B shows in side elevation the structure of FIG. 3A.

Means is provided for retracting the grid from the position shown for it in FIG. 2B to that illustrated in FIG. 3B, and preferably said means comprises an actuator A also mounted on the retract carriage 30, said actuator A having its actuating rod 32 connected to the fixed machine frame F such that the carriage 30, and the stub shaft 26 associated with the grid 16, can be reciprocated between the positions shown in FIGS. 2B and 3B as a result of retraction and extension of the actuator rod 32.

Figure 10:
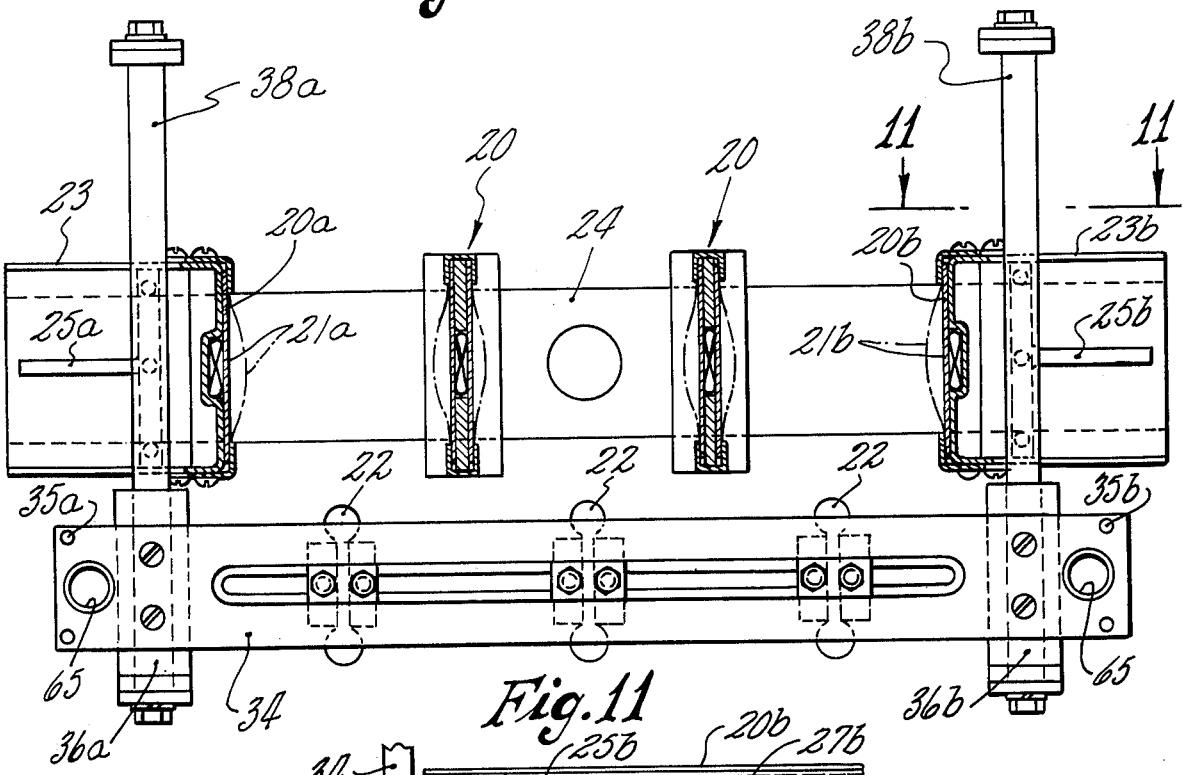
FIG. 10 is a sectional view taken on the line 10—10 of FIG. 3B and showing the details of construction for the outside lane defining elements and the support for the guide rods for the pushdown riding strips.
Figure 11:
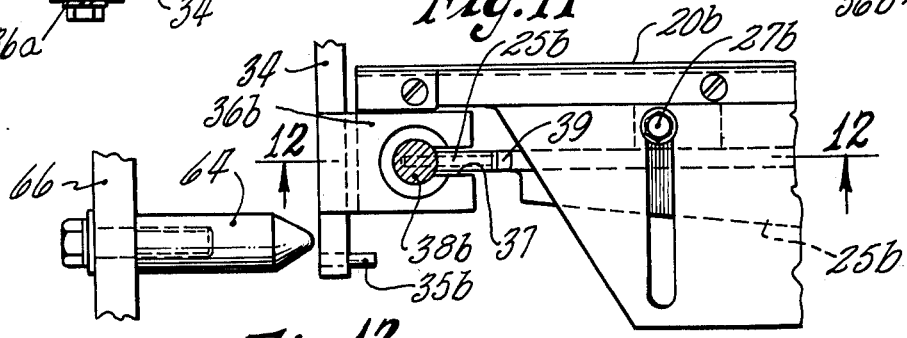
FIG. 11 is a horizontal sectional view taken on the line 11—11 of FIG. 10.
Figure 12:
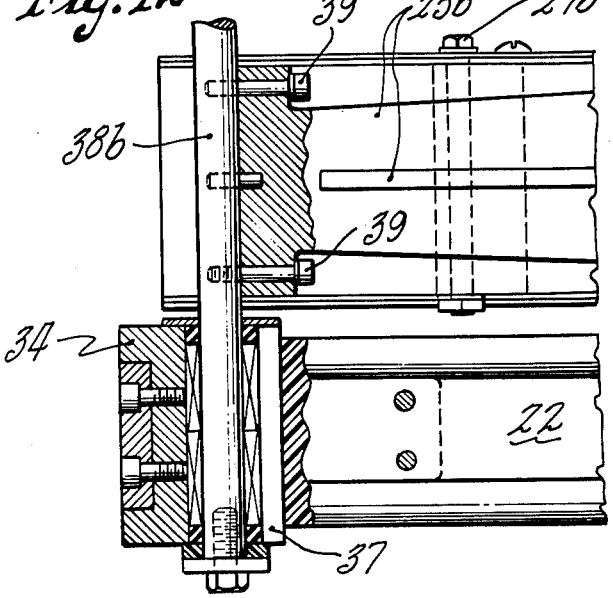
FIG. 12 is a vertical sectional view taken on the line 12—12 of FIG. 11.

Still with reference to the invert grid structure 16, the riding strips, or rails 22, are also mounted cantilevered fashion from a crossbar 34 as shown in FIG. 2A, which crossbar supports the upstream ends of these rails 22, 22 in centered relationship with respect to the lanes defined by the lane defining elements 20, 20 and **20*a* 20*b*. One such rail 22 is associated with each of the lanes. The opposite end portions of the crossbar 34 carrying slide blocks, 36*a* and 36*b* respectively, and these slide blocks are in turn slidably supported on guide rods 38*a* and 38*b* respectively. The guide rods 38*a* and 38*b* are supported on the outer lane defining structures, 20*a* and 20*b* respectively, and the rails 22, 22 and crossbar 34 are adapted to be moved from the FIG. 4B to the FIG. 5B position in the grid structure at the appropriate time during the cycle of operation of the apparatus described herein. FIGS. 10, 11 and 12 show in some detail the means for mounting the rods 38*a* and 38*b* to the outer lane defining structures 20*a* and 20*b* respectively. The outer lane defining structures 20*a* and 20*b*, like the elements 20, 20, include bladders (not shown) for expanding the steel plates 21*a* and 21*b* from the solid to the phantom line positions shown. The elements 20, 20 have two such plates and therefore the bladders which expand them are free to expand laterally. In the outside lane defining structures the bladders only expand inwardly, and therefore the gripping force exerted on the articles must be reacted without excessive deflection of the free ends of these cantilevered structures. Any excessive deflection is prevented by the channel shaped members 23*a* and 23*b*, and by the T-shaped support members 25*a* and 25*b*.**

Each outer land defining structure **20*b* comprises a T-shaped member 25*b* supported at its downstream end from the plate 24 and a channel shaped member 23*b* adjustably bolted thereto at spaced locations, as best shown at 27*b* in FIG. 11. Slots in the upper and lower legs of the channel member 23*b*** allow these members to be laterally adjusted to accommodate different size articles, and different numbers of rows or columns.

Still with reference to the T-shaped members **25*a* and 25*b*, FIG. 12 shows the upstream end of member 25*b* as having a vertically elongated configuration to loosely receive a slot 37*b* in the slide block 36*b*, and the guide rod 38***b* is supported on the upstream end of member 25*b* by two screws 39, 39 best shown in FIG. 12.

Thus the crossbar 34 is mounted on the slide blocks 36*a* and 36*b* for vertical movement on the guide rods 38*a* and 38*b*. The riding strips or rails 22, 22 are adjustably mounted on the crossbar 34 and are also supported cantilever fashion, but with their free ends extending in the downstream direction as best shown in FIG. 2A.

Figure 6:
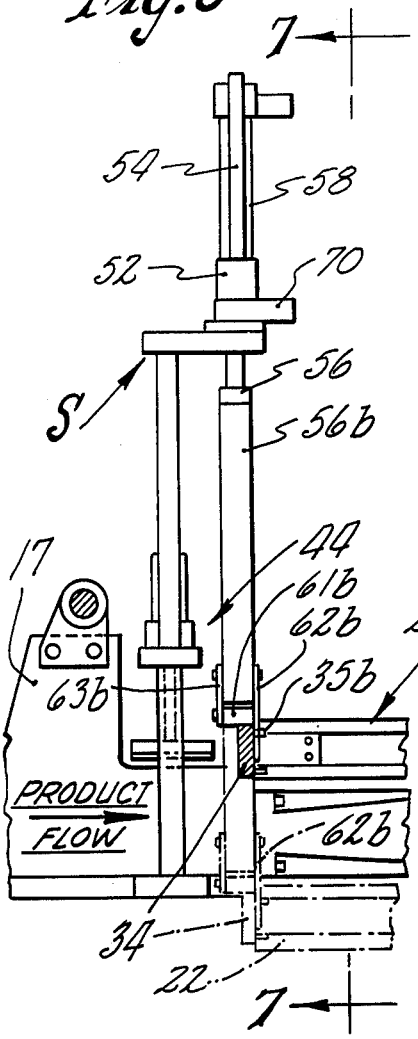
FIG. 6 is a side elevation view of a portion of the apparatus depicted in FIGS. 2B through 5B inclusively, and with the riding strips or rails in their raised position and also in their lowered position (the latter being illustrated in broken lines) and with the structure for achieving this motion of these riding strips also being shown in detail.

FIG. 6 shows in some detail the mechanism for moving these rails or riding strips and it is a feature of the present invention that this mechanism only moves these rails downwardly. The rails are returned to the up position solely by reason of rotation of the grid during the invert motion, that is, during the motion illustrated schematically in FIG. 1B.

Figure 13:
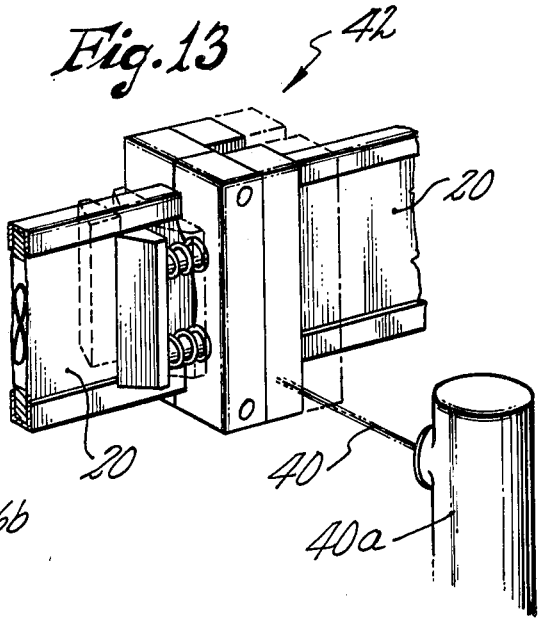
FIG. 13 is a perspective view of the article detecting means associated with the grid lanes, the phantom lines showing a portion of the device in its open condition to pass a light beam.
Figure 1C:
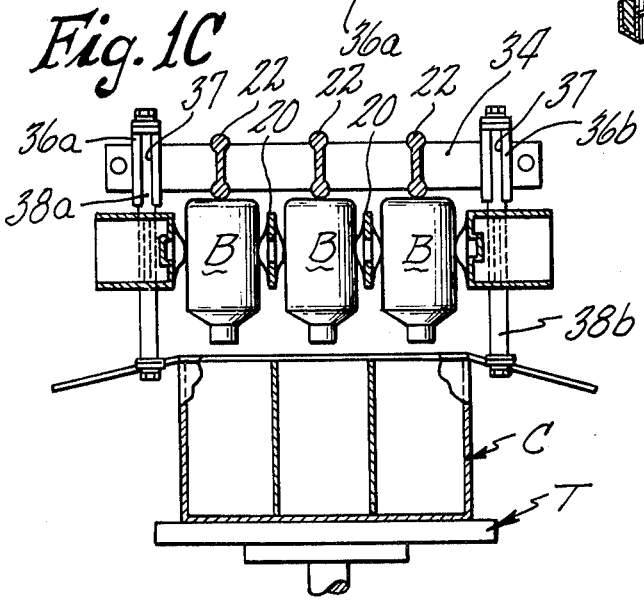

Continuing with the cycle of operation for the mechanism disclosed, and more particularly considering FIGS. 3A and 3B, the grid structure 16 is shown retracted, and the retract actuator A. The optical sensing device, indicated generally at 40*a* and 40*b*, includes a light beam 40 which light beam is normally interrupted by devices 42, 42 located on the lane defining elements 20, 20. Downstream portions of these devices are adapted to move when the grid is filled with a charge of articles, as best shown in FIG. 13, in order to open up a path for the light beam 40 to the transducer 40b and produce a signal for actuation of the line brakes 44 associated with the articles B, B on the deadplate 12 between the infeed conveyor 10 and the grid structure 16. The same signal is also applied to a solenoid valve, as referred to previously, to inflat the bladders associated with the lane defining elements 20, 20 and structures 20*a* and 20*b*. After a short delay to allow time for such bladder inflation the retract cylinder or actuator A retracts the grid 16 to the position shown in FIGS. 3A and 3B. The delay is achieved by the time required for the downward movement of the lime brake 44 actuating switch 15. This motion provides a shear line gap or clearance between the upstream end of the grid 16 and the deadplate 12, and more particularly between the articles on the grid and those held back by the line brake 44. Retract switch 68 provides a signal to motor M initiating rotation of the grid 16 from the position shown in FIG. 3B to that illustrated in FIG. 4B.

Figure 4A:
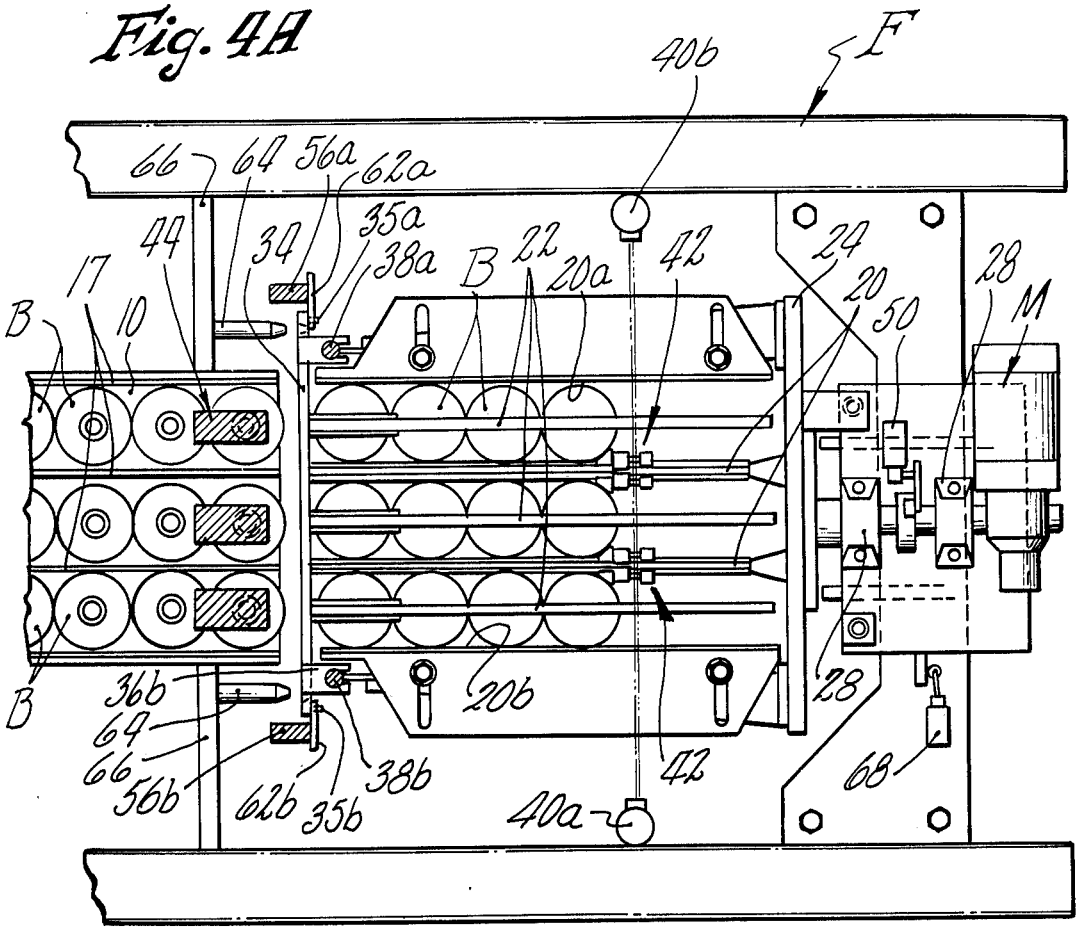
FIG. 4A is similar to FIGS. 2A and 3A except that the grid has been rotated to the inverted position and a packing case has been positioned therebelow.
Figure 4B:
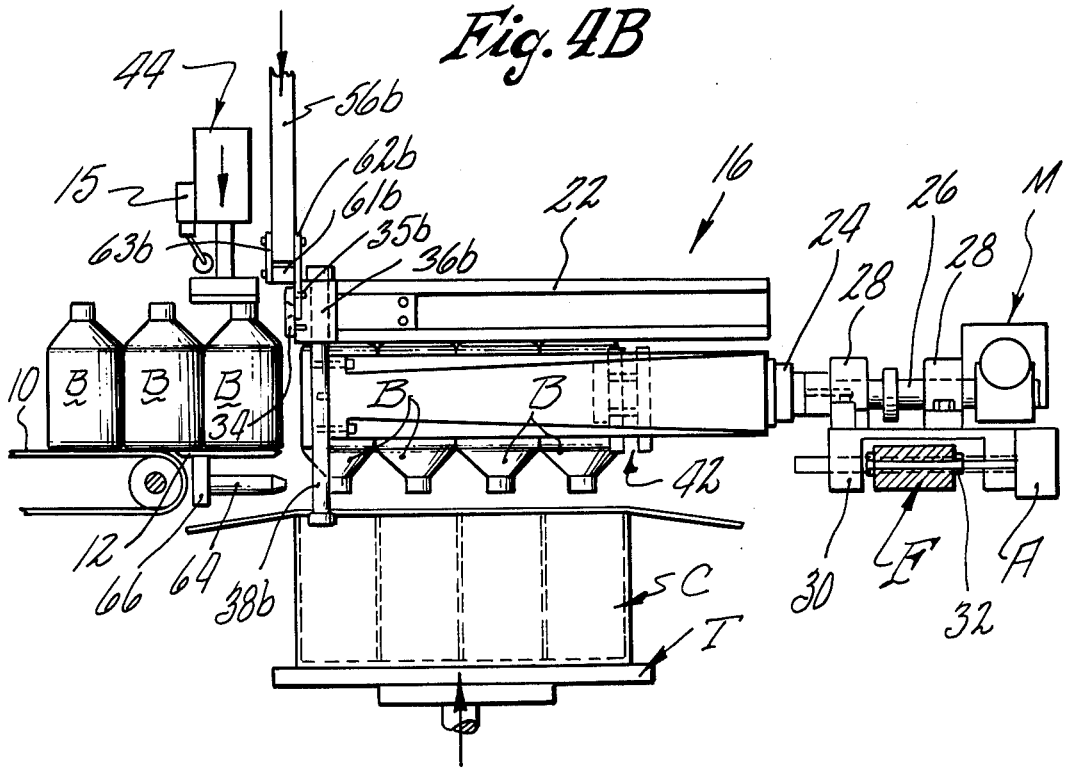
FIG. 4B is a side elevational view of the structure illustrated in FIG. 4A.
Figure 7:
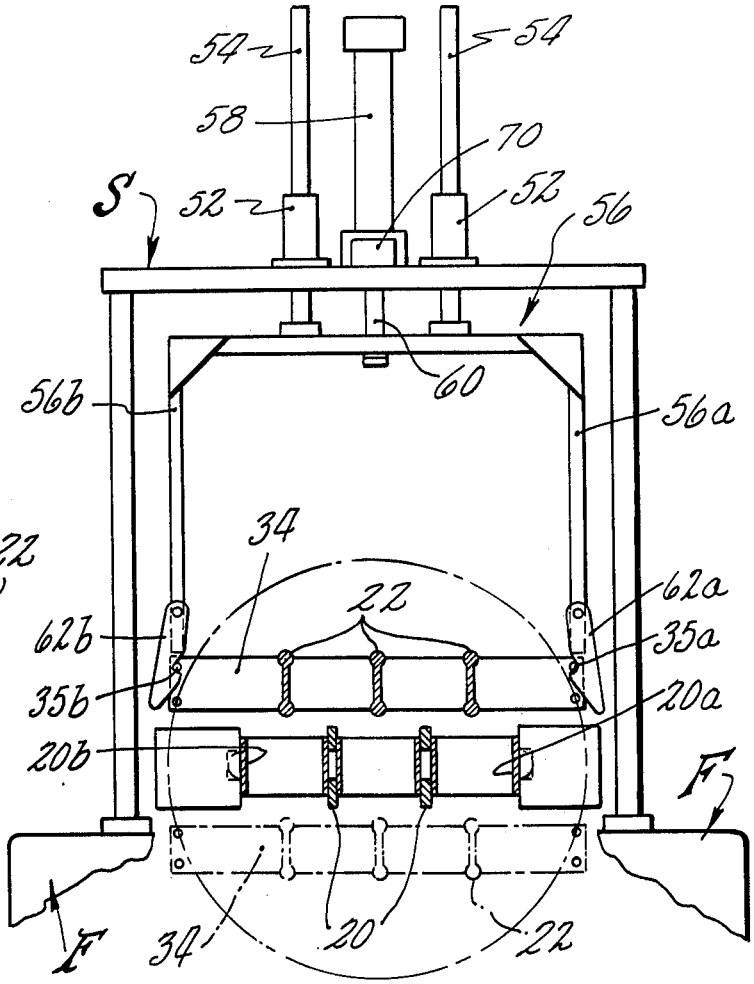
FIG. 7 is a vertical, sectional view taken in elevation along the lines 7—7 of FIG. 6.

Once the grid 16 has rotated through 180° to invert the articles as shown in FIG. 4B a rotating cam on shaft 26 trips a limit switch 50 on the retract carriage 30 providing a signal to the apparatus of FIG. 7 such that the riding strips or rails 22 are moved downwardly from the position shown in full lines in FIGS. 6 and 7 to the broken line position. This motion of the strips or rails 22, 22 serves to positively push the articles from the grid, as illustrated schematically in FIG. 1D. The bladders are also deflated by limit switch 50 in order to facilitate the and positive pushdown of the articles.

Figure 8:
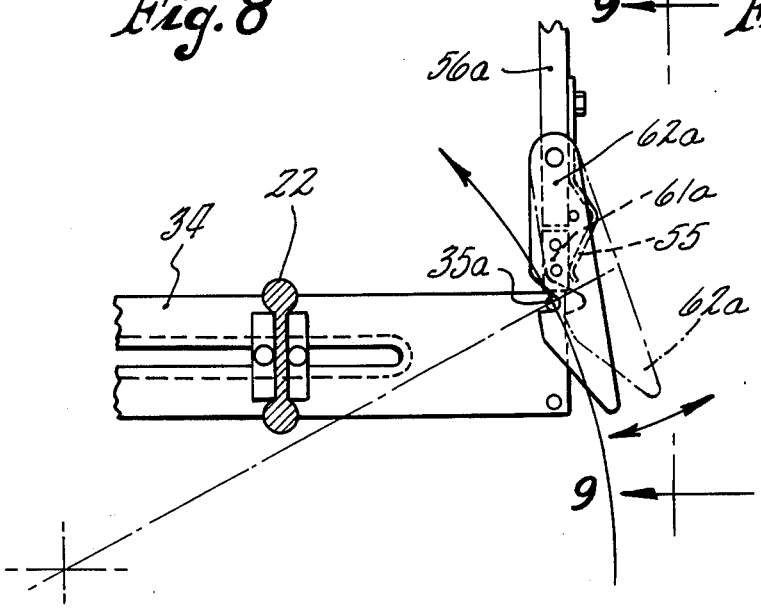
FIG. 8 is a detailed view of a portion of the apparatus depicted in FIG. 7.

Referring now in greater detail to the pushdown mechanism of FIGS. 6, 7 and 8, the machine frame F includes a superstructure S which includes a pair of slide bearings 52, 52 each of which is adapted to guide rods 54, 54 associated with a yoke 56 such that the yoke can be guided for movement between the raised position, shown in full lines in FIG. 7, to the lower position, indicated generally by the broken lines for the crossbar 34 and associated rails 22, 22. Movement of the yoke in its associated superstructure S is provided for by an actuator 58 having its fixed part mounted to the superstructure and having its movable part connected to the yoke, as indicated generally at 60 in FIG. 7. The legs 56*a* and 56*b* of the yoke 56 have depending leg portions which pivotally support latch hooks 62*a* and 62*b*.

Figure 1B:
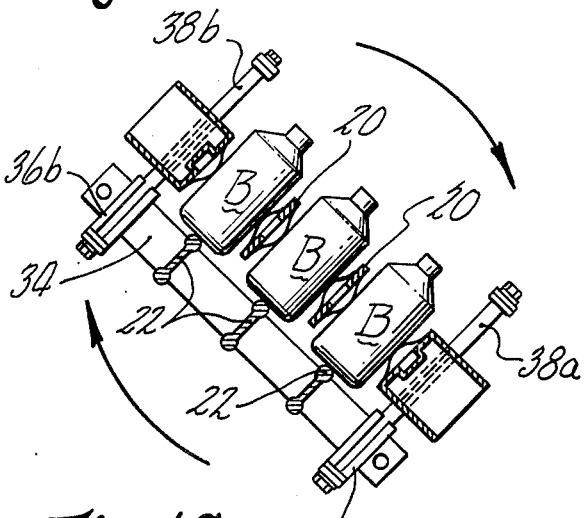
Figure 9:
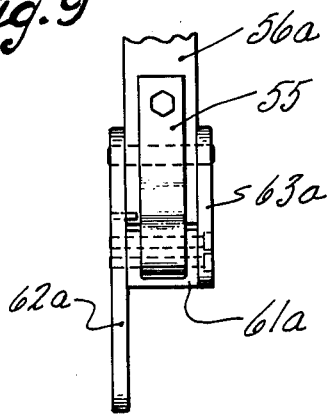
FIG. 9 is a detailed elevational view of the structure shown in FIG. 8.

As best shown in FIGS. 8 and 9 wherein one such leg 56*a* of the yoke is shown in detail, the latch hook 62*a* is spring biased to the solid line position shown but is adapted to be moved toward the broken line position as a result of rotation of the grid 16 and more particularly, as a result of movement of a pin 35*a* provided on the crossbar 34, which crossbar is attached to and carried by the grid 16 at least during invert motion of the grid while a charge of articles is being inverted as shown in FIG. 1B. The other latch hook 62*a* associated with the opposite side of the yoke 56 engages a corresponding pin 35*b*, which pin will also latch to its associated hook 62*b* in response to rotation of the grid 16 in transition between the FIGS. 3B and 4B positions. The hooks are unlatched as a result of the return motion of the retract carriage and associated grid 16 as suggested in FIG. 5A for example. Thus, with the grid in position for receiving a second or succeeding charge of articles these latch hooks and pins will be unlatched as suggested in FIG. 2A. FIG. 9 shows the latch hook 62*a* and the pin for pivotally connecting the hook to the lower end of the yoke leg 56*b*. A back plate 63*a* is also mounted for pivotal movement on the pin, and a nylon block 61*a* is provided between the back plate 63*a* and the hook 62*a* for movement therewith. The spring 55 acts on the nylon block, and the block engages the crossbar 34 for achieving the pushdown motion of the riding strips 22, 22.

Figure 5A:
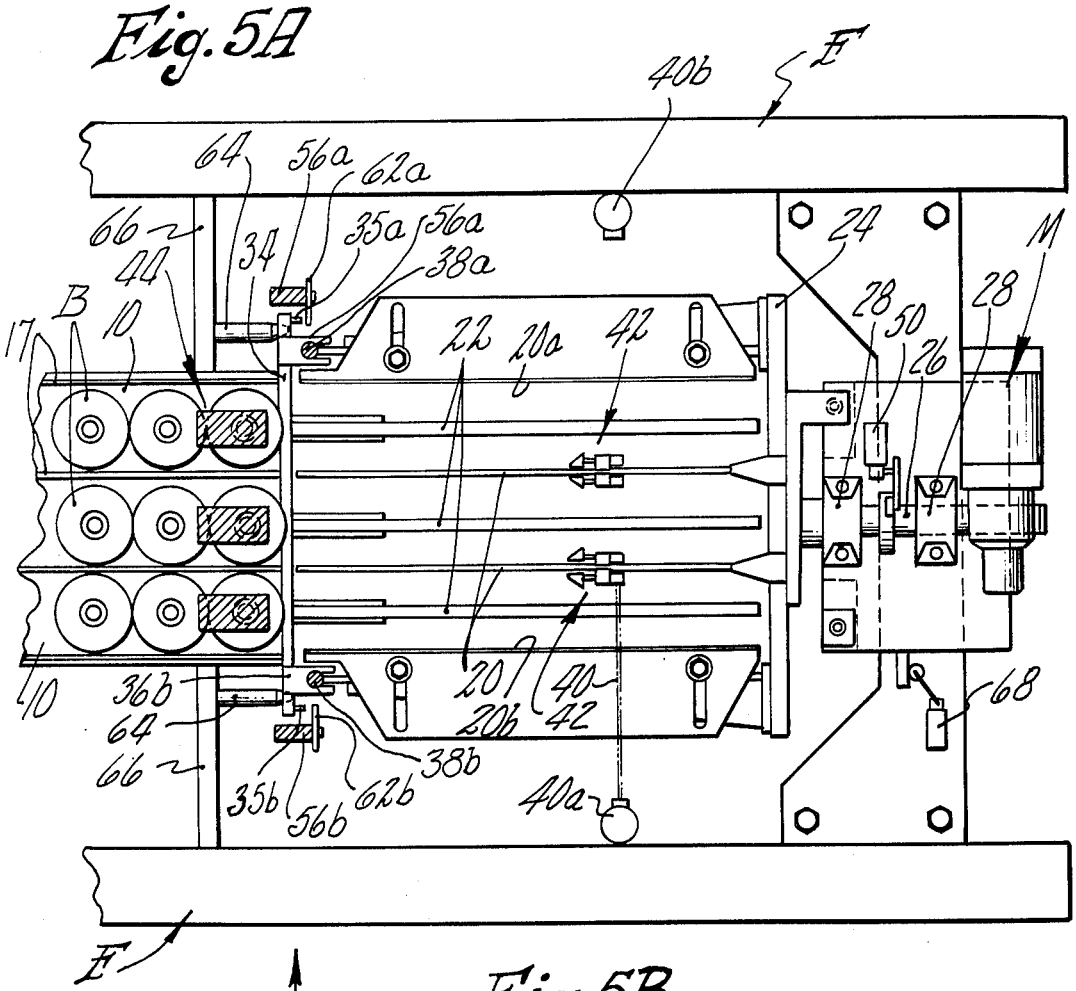
FIG. 5A illustrates in plan view the structure of FIGS. 1A-4A inclusively but with the articles having been pushed from the grid and with the grid having been reset, that is returned to its initial position adjacent the downstream end of the deadplate associated with the infeed conveyor.
Figure 5B:
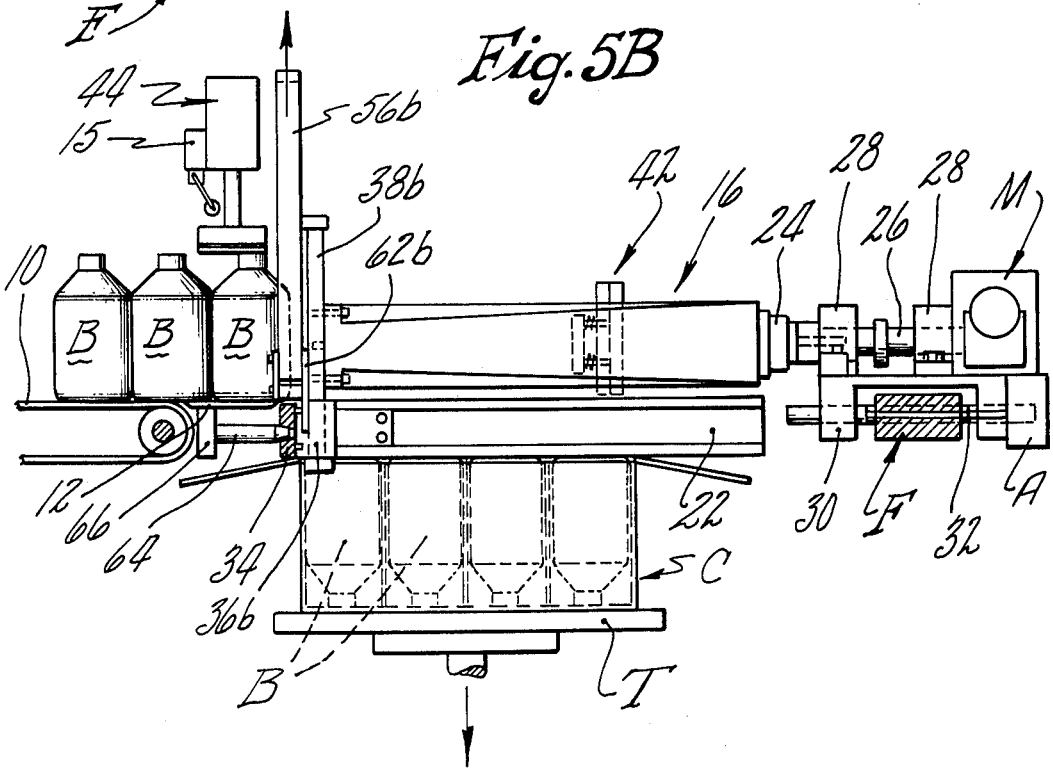
FIG. 5B is a side elevational view of the apparatus depicted in FIG. 5A, and also illustrates the riding strips or rails in their lowered or down position.

In the latched configuration, illustrated in FIGS. 4A and 4B, the pushdown yoke 56 will serve to push the rails 22 downwardly from the position illustrated in FIGS. 4B to that illustrated in FIG. 5B and this will be accomplished simultaneously with deflation of the expandable lane defining elements 20, 20 mentioned previously.

Still with reference to FIGS. 5A and 5B, a pushdown detector switch 70, best shown in FIG. 6, indicates when the pushdown stroke has been completed and at this time the retract actuator A is reset to return the grid 16 to a position adjacent the downstream edge of the deadplate 12 as depicted in FIGS. 5A and 5B.

As the grid 16 is shifted upstream, or reset, by the actuator A, locator pins 64, 64 in the fixed crossbar frame 66 engage locator openings 65, 65 provided for this purpose in the crossbar 34. The return, or reset motion of the grid 16, also results in unlatching of the pins 35*a* and 35*b* from the latch hooks 62*a* and 62*b* on the legs 56*a* and 56*b* of the yoke 56 as described previously. As the grid 16 reaches its reset, or upstream position adjacent the downstream end of the deadplate 12, a limit switch 68 mounted on the machine frame is tripped, providing a signal to the line brake 44 releasing it so that articles B, B can be fed into the lane defining structure of the grid and sending the push down yoke back up. The rails 22, 22 need not be returned, and in fact are designed to receive the articles on their upper edges just as the previous charge or slug of articles was received on the opposite edges depicted in the lower sides in FIG. 5B. The grid structure itself need not be returned, but will be immediately available for receiving articles from the infeed conveyor 10 as a result of the fact that the axis of rotation for the grid 16 is located generally centrally of the lane defining structure in the grid, and which axis of rotation is spaced slightly above the upper surface of the infeed conveyor 10 in order to achieve the basic purpose of the present invention as outlined previously. Still with reference to FIG. 5B, once the line brake 44 has released the articles B, B the configuration of the apparatus is identical to that depicted in FIG. 2B except that the grid structure 16 and associated riding strips or rails 22 will have been reversed. Thus, these elements of the invert grid are immediately available in position for receiving a succeeding charge or slug of articles without the necessity for undergoing any return motion as is the case in prior art invert grid structures generally.

The cycle of operation of the apparatus disclosed herein has been adequately described with reference to the description of the structure itself. However, it should perhaps be noted that the crossbar 24 associated with the riding strips 22, 22 does have two sets of four pins arranged at the opposite ends thereof, two of which pins are used when the grid structure is in one of its two possible positions, and the other of such pins being adapted for use when the grid structure is in its opposite position. However, the symmetry of the grid structure is such that both the lane defining means and the riding strips are constructed symmetrically in order that each is adapted to perform its function whether in the first or the second of its alternative positions depicted in FIGS. 2B and 5B respectively.

We claim:

1. Apparatus for loading groups of articles into open packing cases, comprising an infeed conveyor for advancing the articles in a plurality of lanes, lane defining grid means for receiving a charge of articles when in a first position adjacent the downstream end of said infeed conveyor, said grid means including means for holding the charge of articles in said lane defining grid means, means for rotating said grid means from said first position to an article discharge or second position, rails associated with the lanes of said grid means for engaging the bottoms of the articles in said grid means when said grid means in said first position, and means for moving said rails at least when said grid means is in its second position to push the articles out of said grid means and into a packing case.

2. Apparatus according to claim 1 wherein said second position for said grid means is angularly spaced from said first position by 180°, and wherein said rails are movable from said article supporting position to a second position such that said rails support a second charge of articles fed into said lanes of said grid means when said grid means is in said second position, said rails being movable from said second position to said first mentioned position to push the second charge of articles out of said grid means at least when said grid means is in its first position.

3. Apparatus according to claim 1 wherein said means for holding the charge of articles in said lane defining grid means comprises expandable lane defining structure in said grid means, and means for expanding an collapsing said lane defining structure to selectively hold articles in said lanes and to permit articles to be received in said grid means and to be discharged therefrom.

4. Apparatus according to claim 1 further characterized by shaft means for rotatably supporting said grid means for movement about an axis generally in line with the direction of movement of the articles on said conveyor, said axis being spaced above said infeed conveyor so that said lane defining means is also adapted to receive a second charge of articles when said grid means is in said second position, said rails being adapted to engage the bottoms of such articles in said second charge once the rails have pushed the first charge out of said grid means.

5. Apparatus according to claim 4 wherein said means for holding the charge of articles in said lane defining grid means comprises expandable lane defining structure in said grid means, and means for expanding and collapsing said lane defining structure to selectively hold articles in said lanes and to permit articles to be received in said grid means and to be discharged therefrom.

6. Apparatus according to claim 4 wherein said shaft means supports said grid means cantilever fashion from the downstream end of said grid means opposite the upstream end thereof, which upstream end receives said articles from said infeed conveyor, said lane defining structure supported cantilever fashion from said downstream end of said grid means.

7. Apparatus according to claim 4 further characterized by support means for movably supporting said rails in said grid means, said rail support means comprising a crossbar at the upstream end of said grid means, which upstream end receives said articles from said infeed conveyor, said crossbar supporting said rails, and guide rods for slidably supporting said cross bar for movement of said rails between said alternative positions associated with supporting and then pushing out said first and second charges.

8. Apparatus according to claim 7 wherein said means for holding the charge of articles in said lane defining grid means comprises expandable lane defining structure in said grid means, and means for expanding and collapsing said lane defining structure to selectively hold articles in said lanes and to permit articles to be received in said grid means and to be discharged therefrom.

9. Apparatus according to claim 8 wherein said shaft means supports said grid means cantilever fashion from the downstream end of said grid means opposite the upstream end thereof, which upstream end receives said articles from said infeed conveyor, said lane defining structure supported cantilever fashion from said downstream end of said grid means.

10. Apparatus according to claim 9 wherein said means for moving said rails comprises a vertically reciprocable yoke mounted in fixed structure, and latching means provided in part on end portions of said crossbar and in part on said yoke to move said crossbar downwardly in response to downward movement of said yoke and to nevertheless permit return movement of the yoke independent of the crossbar motion when said latching means is unlatched.

11. Apparatus according to claim 10 further characterized by means for sliding said grid means axially on said shaft means between a forward article loading position and a retracted grid rotatable position, said latching means being unlatched when said grid is reset from its retracted position.

12. Apparatus according to claim 11 further characterized by means for detecting the presence of predetermined numbers of articles in the lanes of said grid means, said means for holding the charge of articles in said lanes operable in response to said lane detecting means, and means for holding back the articles on said infeed conveyor and also operable in response to said lane detecting means.

13. Apparatus according to claim 12 wherein said means for holding the charge of articles in said lane defining grid means comprises expandable lane defining structure in said grid means, and means for expanding and collapsing said lane defining structure to selectively hold articles in said lanes and to permit articles to be received in said grid means and to be discharged therefrom.

14. Apparatus according to claim 12 further characterized by means responsive to said grid means reaching its retract position, and means responsive to rotation of said grid means from said first to said second position, said means for moving said rails to push articles out of said grid means operable in response to release of said article holding means and in response to said grid retract and rotation responsive means.

15. Apparatus according to claim 12 further characterized by means responsive to said yoke reaching said downward position, said grid retract means being returned to said article load position and said article holdback means being released in response to said yoke down position responsive means.

16. Apparatus for loading groups of articles into open packing cases, comprising an infeed conveyor for advancing the articles in a plurality of lanes, lane defining grid means for receiving a charge of articles when in a first position adjacent the downstream end of said infeed conveyor, shaft means for rotatably supporting said grid means for movement about an axis generally in line with the direction of movement of the articles on the conveyor, said axis being spaced above said infeed conveyor, means for rotating said grid means from said first to a second position 180° from the first position to receive a second charge of articles in the inverted grid means, and rails associated with the lanes of said grid means to engage the bottoms of articles therein, said rails being movable between first and second positions spaced on opposite sides of said axis of rotation of said grid means to support the articles received in said grid when the latter is in its first and second positions respectively.

17. Apparatus according to claim 16 further characterized by means for holding the charge of articles in said lane defining grid means and comprising expandable lane defining grid structure.

18. Apparatus according to claim 17 wherein said shaft means supports said grid means cantilever fashion from the downstream end of said grid means opposite the upstream end thereof, which upstream end receives said articles from said infeed conveyor, said lane defining structure supported cantilever fashion from said downstream end of said grid means.

19. Apparatus according to claim 17 further characterized by support means for movably supporting said rails in said grid means, said rail support means comprising a crossbar at the upstream end of said grid means, which upstream end receives said articles from said infeed conveyor, said crossbar supporting said rails, and guide rods for slidably supporting said crossbar for movement of said rails between said alternative positions associated with supporting and then pushing out said first and second charges.

20. Apparatus according to claim 17 further characterized by means for moving said rails and comprising a vertically reciprocable yoke mounted in fixed structure, and latching means provided in part on end portions of said crossbar and in part on said yoke to move said crossbar downwardly in response to downward movement of said yoke and to nevertheless permit return movement of the yoke independent of the crossbar motion when said latching means is unlatched.

21. Apparatus according to claim 20 further characterized by means for sliding said grid means axially on said shaft means between a forward article loading position and a retracted grid rotatable position, said latching means being unlatched when said grid is reset from its retracted position.

22. Apparatus according to claim 21 further characterized by means for detecting the presence of predetermined numbers or articles in the lanes of said grid means, said means for holding the charge of articles in said lanes operable in response to said lane detecting means, and means for holding back the articles on said infeed conveyor and also operable in response to said lane detecting means.

23. Apparatus according to claim 22 further characterized by means responsive to said grid means reaching its retract position, and means responsive to rotation of said grid means from said first to said second position, said means for moving said rails to push articles out of said grid means operable in response to release of said articles holding means and in response to said grid retract and rotation responsive means.

24. Apparatus according to claim 22 further characterized by means responsive to said yoke reaching said downward position, said grid retract means being returned to said article load position and said article holdback means being released in response to said yoke down position responsive means.

* * * * *

UNITED STATES PATENT OFFICE

CERTIFICATE OF CORRECTION

Patent No. 4,048,783 Dated September 20, 1977

Inventor(s) John L. Raudat and Lloyd D. Johnson

It is certified that error appears in the above-identified patent and that said Letters Patent are hereby corrected as shown below:

Col. 1, line 13, after "et al" delete ".".

Col. 2, line 17, "gride" should be --grid--.

Col. 2, line 44, "lines" should be --line--.

Col. 2, line 68, "and" should be deleted after "discrete".

Col. 3, line 61, "," should be --.--.

Col. 4, line 30, "20a 20b" should be --20a, 20b--.

Col. 4, line 32, "carrying" should be --carry--.

Col. 4, line 57, "land" should be --lane--.

Col. 5, line 37, "lime" should be --line--.

Col. 5, line 55, "and" should be deleted.

UNITED STATES PATENT OFFICE

CERTIFICATE OF CORRECTION

Patent No. 4,048,783 Dated September 20, 1977

Inventor(s) John L. Raudat and Lloyd D. Johnson

It is certified that error appears in the above-identified patent and that said Letters Patent are hereby corrected as shown below:

Col. 6, line 4, "of the yoke is" should be --of the yoke 56 is--.

Col. 6, line 12, "62a" should be --62b--.

Col. 6, line 34, "Figs." should be --Fig.--.

Col. 7, line 14, "crossbar 24 should be --crossbar 34--.

Col. 7, line 56, "an" should be --and--.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*